US007926918B2

(12) United States Patent
Katayama

(10) Patent No.: US 7,926,918 B2
(45) Date of Patent: Apr. 19, 2011

(54) METHOD FOR DRIVING HEAD FOR LIQUID-DROPLET JETTING APPARATUS, AND HEAD FOR LIQUID-DROPLET JETTING APPARATUS

(75) Inventor: Naoki Katayama, Kariya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 876 days.

(21) Appl. No.: 11/903,619

(22) Filed: Sep. 24, 2007

(65) Prior Publication Data

US 2008/0074475 A1 Mar. 27, 2008

(30) Foreign Application Priority Data

Sep. 27, 2006 (JP) ..... 2006-261790

(51) Int. Cl.
*B41J 2/045* (2006.01)

(52) U.S. Cl. ..... 347/70; 347/71

(58) Field of Classification Search ..... 347/70, 347/71

See application file for complete search history.

(56) References Cited

U.S. PATENT DOCUMENTS

| | | | | |
|---|---|---|---|---|
| 5,852,337 | A | 12/1998 | Takeuchi et al. | |
| 6,450,626 | B2 | 9/2002 | Ikeda | |
| 6,971,738 | B2 | 12/2005 | Sugahara | |
| 2003/0142173 | A1 * | 7/2003 | Takahashi | 347/68 |
| 2006/0082619 | A1 | 4/2006 | Yasui | |
| 2006/0152556 | A1 | 7/2006 | Sugahara | |

FOREIGN PATENT DOCUMENTS

| | | |
|---|---|---|
| JP | 2000103056 | 4/2000 |
| JP | 2001179969 | 7/2001 |
| JP | 2004166463 | 6/2004 |
| JP | 2006093348 | 4/2006 |

* cited by examiner

*Primary Examiner* — Jerry T Rahll

(74) *Attorney, Agent, or Firm* — Frommer Lawrence & Haug LLP

(57) ABSTRACT

A piezoelectric layer is provided on a vibration plate which covers a plurality of pressure chambers extending in a predetermined direction. The piezoelectric layer has a first area corresponding to a central portion in a width direction of each of the pressure chambers and a second area corresponding to both sides in a longitudinal direction of an inner peripheral portion of each of the pressure chambers. A head for a liquid-droplet jetting apparatus which has the piezoelectric layer is prepared, and when the head is driven, a first driving step for applying a drive voltage to the second area, and the first area corresponding to a pressure chamber which does not jet a liquid droplet is carried out. Thereafter, a second driving step for applying a drive voltage to the first area corresponding to a pressure chamber which discharges the liquid droplet is carried out.

9 Claims, 11 Drawing Sheets

METHOD FOR DRIVING HEAD FOR LIQUID-DROPLET JETTING APPARATUS, AND HEAD FOR LIQUID-DROPLET JETTING APPARATUS

CROSS-REFERENCE TO RELATED APPLICATION

The present application claims priority from Japanese Patent Application No. 2006-261790, filed on Sep. 27, 2006, the disclosure of which is incorporated herein by reference in its entirety.

BACKGROUND OF THE INVENTION

1. Field of the Invention

The present invention relates to a method for driving a head for a liquid-droplet jetting apparatus such as a head for an ink-jet printer, and a head for a liquid-droplet jetting apparatus such as a head for an ink-jet printer.

2. Description of the Related Art

In recent years, in an ink-jet printer which is a type of a liquid-droplet jetting apparatus, while there has been advancement in size reduction of a head, high densification of nozzles, and increasing a number of channels, a cost reduction has been facilitated.

With a reduction in size of the head, an area of an actuator which can be used per channel (in other words, one cavity which is one pressure chamber) tends to decrease. Whereas, there has been no change in a required size of an ink droplet, and a generation of a jetting pressure same as it has hitherto been used is sought in each channel. Therefore, as an existing situation, various ideas have been devised such as to have even slightly larger area of the actuator by reducing a width of a column between adjacent cavities (dimension in a row direction of the cavities), and to raise a drive voltage.

However, when the width of the column between the adjacent cavities is reduced, since a stiffness of the column is decreased, an effect of a cross-talk on the adjacent channels is increased. If the drive voltage is raised, a cost of parts for high voltage increases. Moreover, since an amount of heat generated is increased due to raising the drive voltage to be higher, it is necessary to lower a temperature. However, a design for lowering the temperature is difficult.

In view of the abovementioned circumstances, as it has been disclosed in U.S. Pat. No. 6,971,738 B2 and US Patent Application Publication No. 2006/0152556 A1 (corresponds to Japanese Patent Application Laid-open No. 2004-166463), there have been proposed a piezoelectric actuator, a liquid transporting apparatus, and an ink-jet head in which it is possible to impart a sufficient amount of deformation to a piezoelectric layer even when an area of a piezoelectric material arranged between the electrodes is decreased, and to prevent a deformation of a portion, of an actuator, corresponding to each of pressure chambers from affecting a portion corresponding to another pressure chamber.

However, in a piezoelectric actuator, a liquid transporting apparatus, and an ink-jet head described in U.S. Pat. No. 6,971,738 B2 and US Patent Application Publication No. 2006/0152556 A1, since a structure is such that for increasing an amount of deformation, a plurality of piezoelectric layers is stacked, and electrodes are provided between these stacked layers, the structure becomes complicated, and it is not sufficient from a point of lowering a drive voltage.

SUMMARY OF THE INVENTION

An object of the present invention is to provide a method for driving a head for a liquid droplet jetting apparatus, and the head for the liquid droplet jetting apparatus which are capable of increasing an amount of deformation of an actuator, while suppressing a drive voltage.

According to a first aspect of the present invention, there is provided a method for driving a head for a liquid-droplet jetting apparatus including a vibration plate which covers a plurality of pressure chambers extending in a predetermined direction, and an insulating layer and a piezoelectric layer which are stacked in this order on a surface of the vibration plate, the surface not facing the pressure chambers, the method including: a step for providing a head for the liquid-droplet jetting apparatus which includes a piezoelectric layer having first areas each corresponding to a central portion of one of the pressure chambers, and second areas each corresponding to both sides in a longitudinal direction of an inner peripheral portion of one of the pressure chambers; a first driving step for, when the head is driven, not applying a drive voltage to a first area among the first areas corresponding to a pressure chamber among the pressure chambers which jets a liquid droplet, and applying the drive voltage to the second areas to deform a second area among the second areas corresponding to the pressure chamber which jets the liquid droplet in a direction separating away from the pressure chamber; and a second driving step for applying the drive voltage to the first area corresponding to the pressure chamber which jets the liquid droplet to deform the first area in a direction approaching toward the pressure chamber without applying the drive voltage to the second areas.

According to the method for driving of the present invention, when the head is driven, the first driving step is carried out in which the drive voltage is not applied to a first area among the first areas corresponding to the pressure chamber which jets the liquid droplet, and the drive voltage is applied to the second areas, and a second area among the second areas corresponding to the pressure chamber which jets the liquid droplet is deformed in a direction opposite to the pressure chamber, in other words, in a direction separating away from the pressure chamber. Thereafter, the second driving step is carried out in which the drive voltage is not applied to the second areas, and the drive voltage is applied to the first area among the first areas corresponding to the pressure chamber which jets the liquid droplet, and the first area corresponding to the pressure chamber which jets the liquid droplet is deformed in a direction toward the pressure chamber, in other words, in a direction approaching toward the pressure chamber. In other words, by combining the deformation of the first area and the second area, a drive pressure is generated as a so-called pulling ejection in the first driving step and a so-called pushing ejection in the second driving step (refer to FIG. 9B and FIG. 9C). Consequently, when compared with a head having only one of the pushing ejection and the pulling ejection, it is possible to have a substantial amount of deformation of the piezoelectric layer (actuator) even at the same drive voltage, and a high jetting pressure is acquired. Moreover, with a drive voltage lower than a drive voltage for a head having only one of the pushing ejection and the pulling ejection, it is possible to achieve an amount of deformation of the vibration plate same as of the head having only one of the pushing ejection and the pulling ejection. In the following description, "to apply the drive voltage" to the first area or the second area means generating an electric potential difference between the first area or the second area.

In the method for driving the head for the liquid-droplet jetting apparatus of the present invention, in the first driving step, the drive voltage may be applied to another first area among the first areas corresponding to another pressure chamber among the pressure chambers which does not jet the ink droplet, and the another first area corresponding to the another pressure chamber may be deformed in a direction approaching toward the pressure chamber; and in the second driving step, no drive voltage may be applied to the another first area corresponding to the another pressure chamber. In this case, for the pressure chamber which is not required to jet the liquid droplet, since the first area is deformed in a direction approaching toward the pressure chamber by applying the drive voltage to the first area in the first driving step, the deformation of the first area and the second area is mutually negated, and there is no deformation in any of the two directions (refer to FIG. 9D). Moreover, in the second driving step, since the drive voltage is not applied to any of the first areas and the second areas, there is no deformation in any of the two directions. As a result, there is almost no amount of deformation of the pressure chamber, and the liquid droplet is not jetted.

In the method for driving the head for the liquid-droplet jetting apparatus of the present invention, individual electrodes corresponding to the first areas respectively, and first common electrodes corresponding to the second areas respectively may be arranged on one surface of the piezoelectric layer, and second common electrodes corresponding to the second areas respectively, and third common electrodes corresponding to the first areas respectively may be arranged on the other surface of the piezoelectric layer; in the first driving step, the first common electrodes and the second common electrodes may have mutually different electric potentials, the third common electrodes and an individual electrode among the individual electrodes corresponding to the pressure chamber which jets the liquid droplet may have electric potentials which are same, and the third common electrodes and another individual electrode corresponding to the another pressure chamber which does not jet the liquid droplet may have mutually different electric potentials; and in the second driving step, the first common electrodes and the second common electrodes may have electric potential which are same, and the third common electrode and the individual electrode corresponding to the pressure chamber which jets the liquid droplet may have mutually different electric potentials, and the third common electrodes and the another individual electrode corresponding to the another pressure chamber which does not jet the liquid droplet may have electric potentials which are same. In this case, it is possible to apply the drive voltage to the first areas by the individual electrodes and the third common electrodes, and to apply the drive voltage to the second areas by the first common electrodes and the second common electrodes. Consequently, in the first driving step, it is possible to apply the drive voltage to the second areas, and a first area among the first areas corresponding to the pressure chamber which does not jet the liquid droplet. On the other hand, in the second driving step, it is possible to apply the drive voltage only to another first area among the first areas corresponding to the pressure chamber which jets the liquid droplet. Accordingly, in the first driving step, it is possible to deform the second area, corresponding to the pressure chamber which jets the liquid droplet, in a direction separating away from the pressure chamber. On the other hand, in the second driving step, it is possible to deform the first area, corresponding to the pressure chamber which jets the liquid droplet, in the direction approaching toward the pressure chamber. Consequently, by carrying out the first driving step and the second driving step, it is possible to increase the amount of deformation of the vibration plate.

In the method for driving the head for the liquid-droplet jetting apparatus of the present invention, individual electrodes corresponding to the first areas, and first common electrodes corresponding to the second areas respectively may be arranged on one surface of the piezoelectric layer, and second common electrodes corresponding to the second areas and third common electrodes corresponding to the first areas respectively may be arranged on the other surface of the piezoelectric layer; at least a first electric potential which is a predetermined reference electric potential, and a second electric potential which is different from the first electric potential may be selectively applied to each of the individual electrodes, the first common electrodes, the second common electrodes, and the third common electrodes; in the first driving step, the second electric potential may be applied to the first common electrodes, the first electric potential may be applied to the second common electrodes and the third common electrodes, the first electric potential may be applied to an individual electrode among the individual electrodes corresponding to the pressure chamber which jets the liquid droplet, and the second electric potential may be applied to another individual electrode corresponding to another pressure chamber which does not jet the liquid droplet; and in the second driving step, the second electric potential may be applied to each of the first common electrodes and the second common electrodes, the first electric potential may be applied to the third common electrodes, the second electric potential may be applied to the individual electrode corresponding to the pressure chamber which jets the liquid droplet, and the first electric potential may be applied to the another individual electrode corresponding to the another pressure chamber which does not jet the liquid droplet. Even in this case, in the first driving step, it is possible to apply the drive voltage to the second areas, and a first area among the first areas corresponding to the pressure chamber which does not jet the liquid droplet. On the other hand, in the second driving step, it is possible to apply the drive voltage only to another first area among the first areas corresponding to the pressure chamber which jets the liquid droplet. Accordingly, in the first driving step, it is possible to deform the second area, corresponding to the pressure chamber which jets the liquid droplet, in a direction separating away from the pressure chamber. On the other hand, in the second driving step, it is possible to deform the first area, corresponding to the pressure chamber which jets the liquid droplet, in a direction approaching toward the pressure chamber.

According to a second aspect of the present invention, there is provided a head for a liquid-droplet jetting apparatus including a vibration plate which covers a plurality of pressure chambers extending in a predetermined direction, and an insulating layer and a piezoelectric layer which are stacked in this order on a surface of the vibration plate, the surface not facing the pressure chambers, the method including: individual electrodes each of which is formed on one surface of the piezoelectric layer to cover a central portion of one of the pressure chambers; first common electrodes each of which is formed on the surface of the piezoelectric layer to cover both sides in a longitudinal direction of an inner peripheral portion of one of the pressure chambers; second common electrodes each of which is formed on the other surface of the piezoelectric layer to cover partially two adjacent pressure chambers among the plurality of pressure chambers; and third common electrodes each of which is formed on the other surface of the piezoelectric layer to cover the central portion of one of the pressure chambers.

According to the head for the liquid-droplet jetting apparatus of the present invention, it is possible to generate a driving pressure in the piezoelectric layer (actuator) between the first common electrodes and the second common electrodes, and the piezoelectric layer (actuator) between the individual electrodes and the third common electrodes. Consequently, by combining these driving pressures, it is possible to have a substantial amount of deformation of the vibration plate. Moreover, a structure is simple, and it is not necessary to increase substantially the number of drawn wires.

In the head for the liquid-droplet jetting apparatus of the present invention, the plurality of pressure chambers may form a pressure chamber row in a predetermined direction, and the first common electrodes may be connected in a comb-teeth form to a first drawn wire which extends, on the one surface of the piezoelectric layer, in a direction of the pressure chamber row, the first drawn wire not covering the pressure chambers; and the second common electrodes and the third common electrodes may be connected in a comb-teeth form to a second drawn wire and a third drawn wire respectively, the second and third drawn wires extending, on the other surface of the piezoelectric layer, at both sides in the direction of the pressure chamber row respectively, and not covering the pressure chambers. In this case, it is possible to connect the first common electrodes, the second common electrodes, and the third common electrodes by the minimum number of drawn wires required.

In the head for the liquid-droplet jetting apparatus in the present invention, each of the first common electrodes may be formed to partially cover two adjacent pressure chambers among the plurality of pressure chambers. In this case, since it is possible that two adjacent pressure chambers among the pressure chambers have a first common electrode among the first common electrodes and a second common electrode among the second common electrodes in common, it is possible to simplify an arrangement of the electrodes.

In the head for the liquid-droplet jetting apparatus in the present invention, the second drawn wire may be provided on a side toward which the individual electrodes are drawn, and the first drawn wire and the third drawn wire may be provided opposite to the side toward which the individual electrodes are drawn. In this case, it is possible to arrange easily the first drawn wire, the second drawn wire, and the third drawn wire.

In the head for the liquid-droplet jetting apparatus of the present invention, a width of each of the individual electrodes and the third common electrodes may be about 40 μm to about 50 μm, a width of each of the first common electrodes may be about 50 μm to about 70 μm, and a spacing distance between one of the individual electrodes and one of the first common electrodes may be about 25 μm. In this case, it is possible to secure a substantial amount of deformation of the vibration plate of a jetting channel, without deforming the vibration plate of a non-jetting channel.

According to a third aspect of the present invention, there is provided a liquid-droplet jetting apparatus which jets a liquid droplet of a liquid onto a recording medium, including: a recording medium transporting mechanism which transports the recording medium; a head for the liquid-droplet jetting apparatus as defined in claim 5; and a controller which controls the head and selectively applies a first electric potential which is a predetermined reference electric potential, and a second electric potential which is different from the first electric potential, to each of the individual electrodes, the first common electrodes, the second common electrodes, and the third common electrodes.

In the liquid-droplet jetting apparatus of the present invention, it is possible to control the head for the liquid-droplet jetting apparatus, such that the amount of deformation of the vibration plate is sufficiently increased.

The liquid-droplet jetting apparatus of the present invention may further include a driving circuit which drives the head, and the controller may control the head via the driving circuit.

In the liquid-droplet jetting apparatus of the present invention, when the head is driven, the controller, may apply the second electric potential to the first common electrodes, the second common electrodes, and an individual electrode among the individual electrodes corresponding to a pressure chamber among the pressure chambers which jets the liquid droplet, and the first electric potential to the third common electrodes and another individual electrode corresponding to another pressure chamber which does not jet the liquid droplet, after the controller applies via the driving circuit, the second electric potential to the first common electrodes and the another individual electrode corresponding to the another pressure chamber which does not jet a liquid droplet and the first electric potential to each of the second common electrodes, the third common electrodes, and the individual electrode corresponding to the pressure chamber which jets the liquid droplet. In this case, after deforming a portion of the piezoelectric layer, corresponding to the pressure chamber which jets the liquid droplet, in a direction separating away from the pressure chamber, it is possible to deform the portion of the piezoelectric layer in a direction approaching toward the pressure chamber. Consequently, it is possible to secure about double the amount of deformation of the vibration plate by a drive voltage same as in a case of deforming the vibration plate only in one direction.

In the liquid-droplet jetting apparatus of the present invention, when the head is not driven, the controller may apply, via the driving circuit, the first electric potential to each of the individual electrodes, the first common electrodes, the second common electrodes, and the third common electrodes. In this case, since the drive voltage is not applied to any of the electrodes when the head for the liquid-droplet jetting apparatus is not driven, a migration phenomenon hardly occurs.

DETAILED DESCRIPTION OF THE PREFERRED EMBODIMENTS

An embodiment of the present invention will be described below by referring to the accompanying diagrams.

Figure 1A:
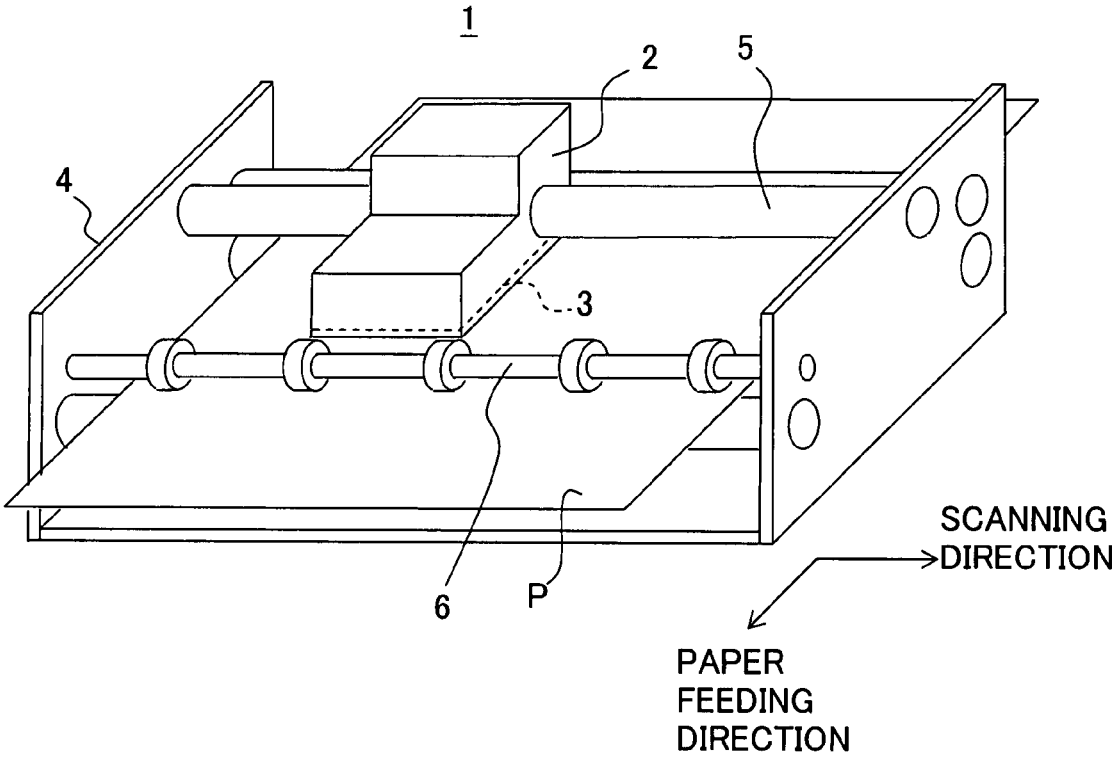
FIG. 1A is a schematic structural view showing a schematic structure of an ink-jet printer according to the present invention.
Figure 1B:
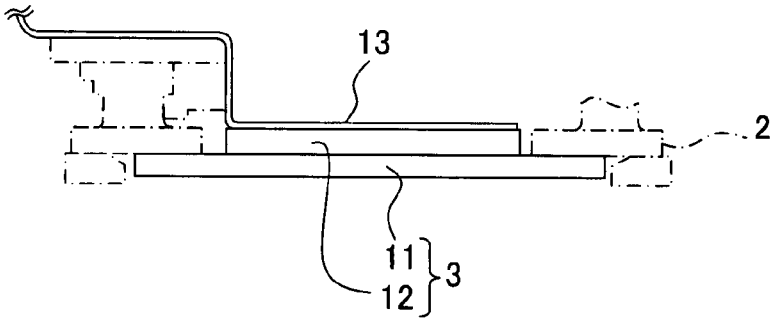
FIG. 1B is a diagram describing a positional relationship of a cavity unit, an actuator unit, and a flexible cable (COP) according to the present invention.

FIG. 1A is a schematic structural view showing a schematic structure of an ink-jet printer 1 according to the present invention, and FIG. 1B is a diagram describing a positional relationship of a cavity unit 11, an actuator unit 12, and a flexible cable (COP) 13.

An ink-jet printer 1 according to the present invention, as shown in FIG. 1A, is provided with a head for the ink-jet printer 3 (hereinafter called as a head for the printer) for recording on a recording paper P (recording medium), on a lower surface of a carriage 2 on which an ink cartridge (not shown in the diagram) is mounted. The carriage 2 is supported by a guide plate (not shown in the diagram) and a carriage shaft 5 provided inside a printer frame 4. The carriage 2 reciprocates in a scanning direction which is orthogonal to a paper feeding direction of the recording paper P.

The recording paper P is transported in the paper feeding direction from a paper feeding section which is not shown in the diagram. In other words, the recording paper P is inserted between a platen roller (not shown in the diagram) and the head for the printer 3. A predetermined recording is carried out on the recording paper P by an ink jetted from the head for the printer 3 toward the recording paper P, and thereafter the recording paper P is discharged by paper discharge rollers 6 (recording paper transporting mechanism).

Figure 2A:
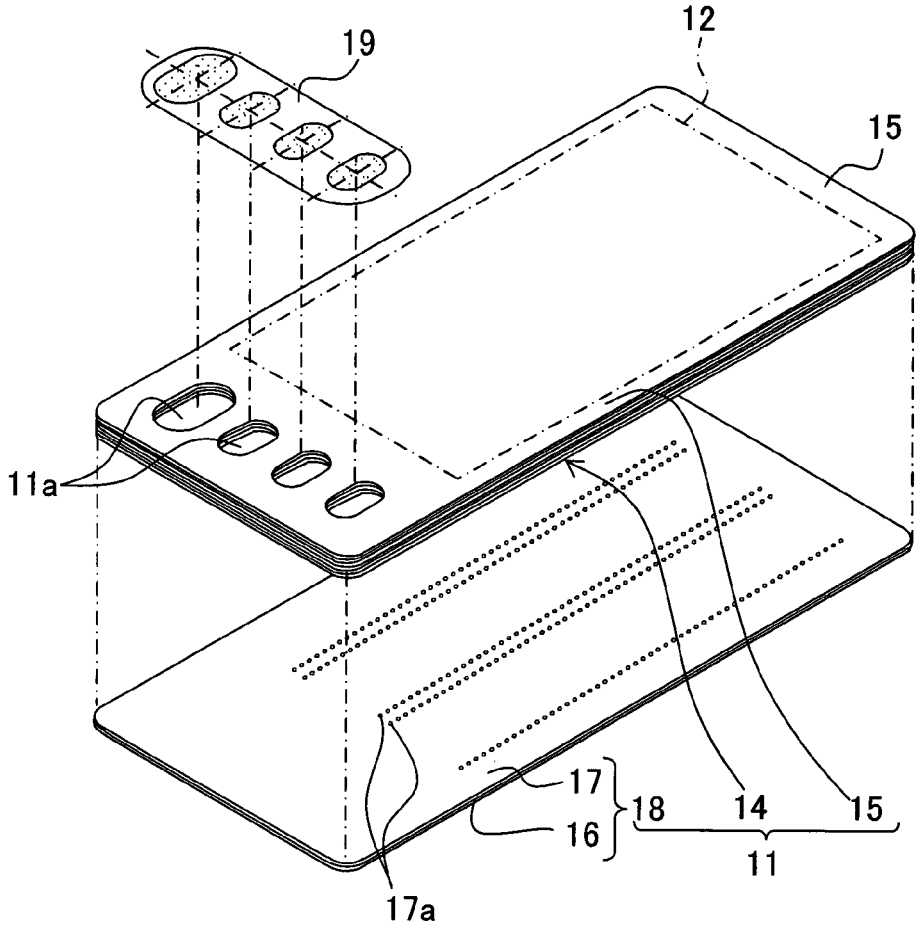
FIG. 2A is a perspective view showing a state of the actuator unit attached to an upper side of the cavity unit.
Figure 2B:
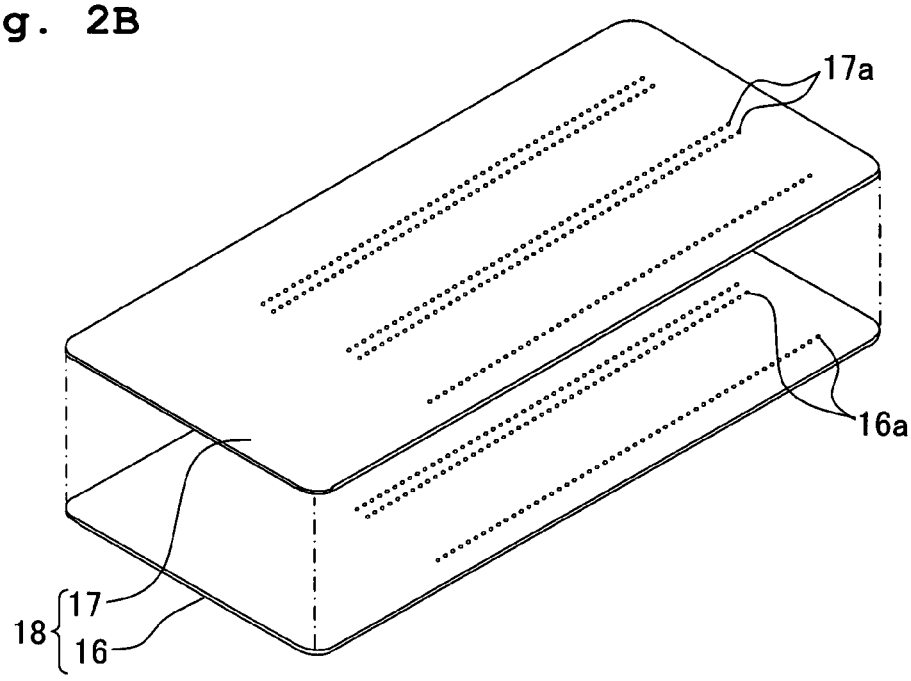
FIG. 2B is an exploded perspective view of a plate assembly which is formed by a nozzle plate and a spacer plate.

Moreover, as shown in FIG. 1B, and FIG. 2A and FIG. 2B, the head for the printer 3 includes the channel unit 11 and an actuator unit 12, and a flexible cable 13 (signal wire) which supplies a drive signal is provided on a surface of the actuator unit 12, not facing the channel unit 11. In the following description, a "vertical direction" means a direction in which the channel unit 11 and the actuator unit 12 are stacked.

Figure 4A:
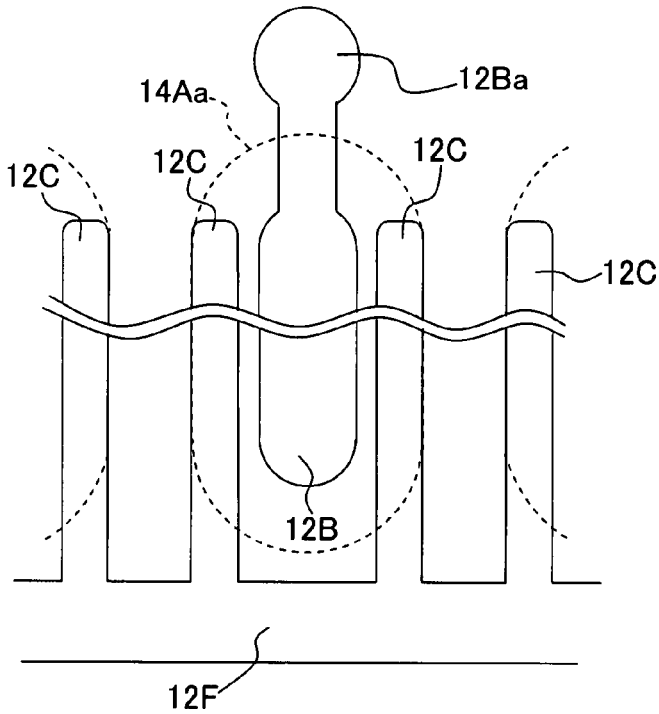
FIG. 4A is a plan view as viewed from a top surface of an actuator unit, showing a positional relationship of an individual electrode, a first common electrode and a pressure chamber.
Figure 4B:
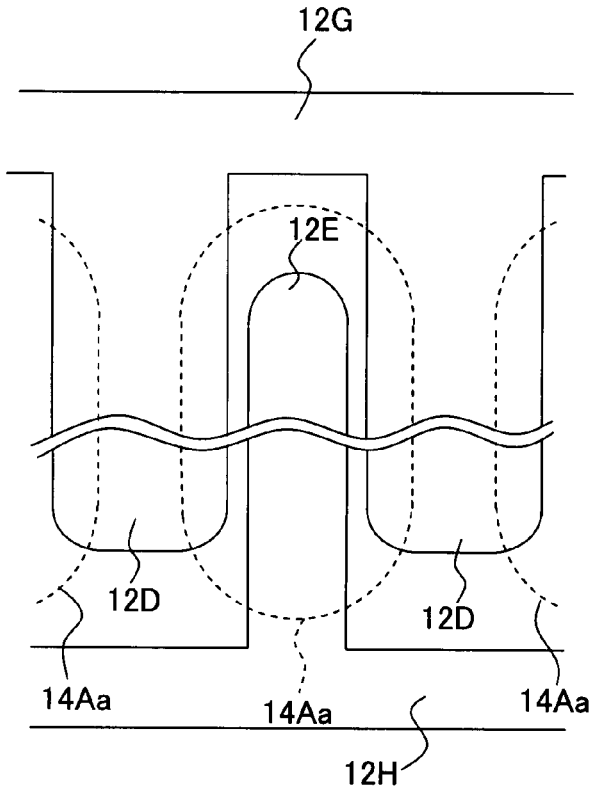
FIG. 4B is a plan view as viewed from a bottom surface of the actuator unit, showing a positional relationship of a second common electrode, a third common electrode, and the pressure chamber.
Figure 4C:
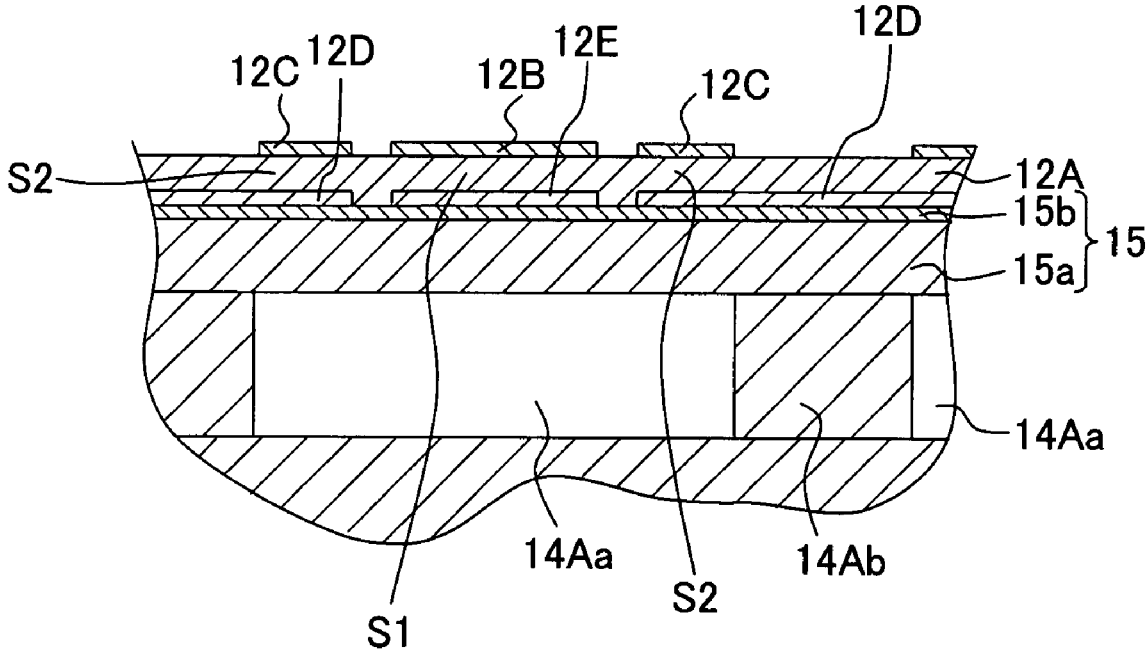
FIG. 4C is a cross-sectional view of main components of a head, showing a positional relationship of the individual electrode, the first common electrode, the second common electrode, the third common electrode, and the pressure chamber.

The channel unit 11 includes a stacked body 14 which is formed by stacking a plurality of plates having an opening. On an upper surface of the stacked body 14, a vibration plate 15 is provided. On the other hand, a plate assembly 18 is integrally attached on a lower surface of the stacked body 14. The plate assembly 18 is formed by attaching a nozzle plate 16 which has nozzles 16*a*, and a spacer plate 17 which has through holes 17*a* corresponding to the nozzles 16*a*. Moreover, the actuator unit 12 is provided on an upper surface of the vibration plate 15 (refer to FIG. 1B). Here, the vibration plate 15, as shown in FIG. 4C which will be described later, is formed by a metallic plate 15*a* which covers pressure chambers 14Aa, and an insulating layer 15*b* which is stacked on the metallic plate 15*a*. Accordingly, the insulating layer 15*b* and a piezoelectric layer 12A which will be described later are stacked on an upper side of the metallic plate portion 15*a*. The vibration plate 15 may be a plate having a surface on a side of the actuator unit 12 (piezoelectric layer 12A) to be an insulating (non-electroconductive) surface and it is also possible to use a plate which is made entirely of a synthetic resin as the vibration plate 15.

Moreover, as shown in FIG. 2A, a filter 19 which captures dust etc. in the ink is provided to an opening 11*a* of the channel unit 11. The nozzle plate 16 is a high-molecular synthetic resin plate (such as polyimide) in which one nozzle 16*a* is provided for each of the pressure chambers 14Aa in a cavity plate 14A which will be described later. The nozzle 16*a* is formed by carrying out an excimer laser process on the high-molecular synthetic resin plate.

Figure 3A:
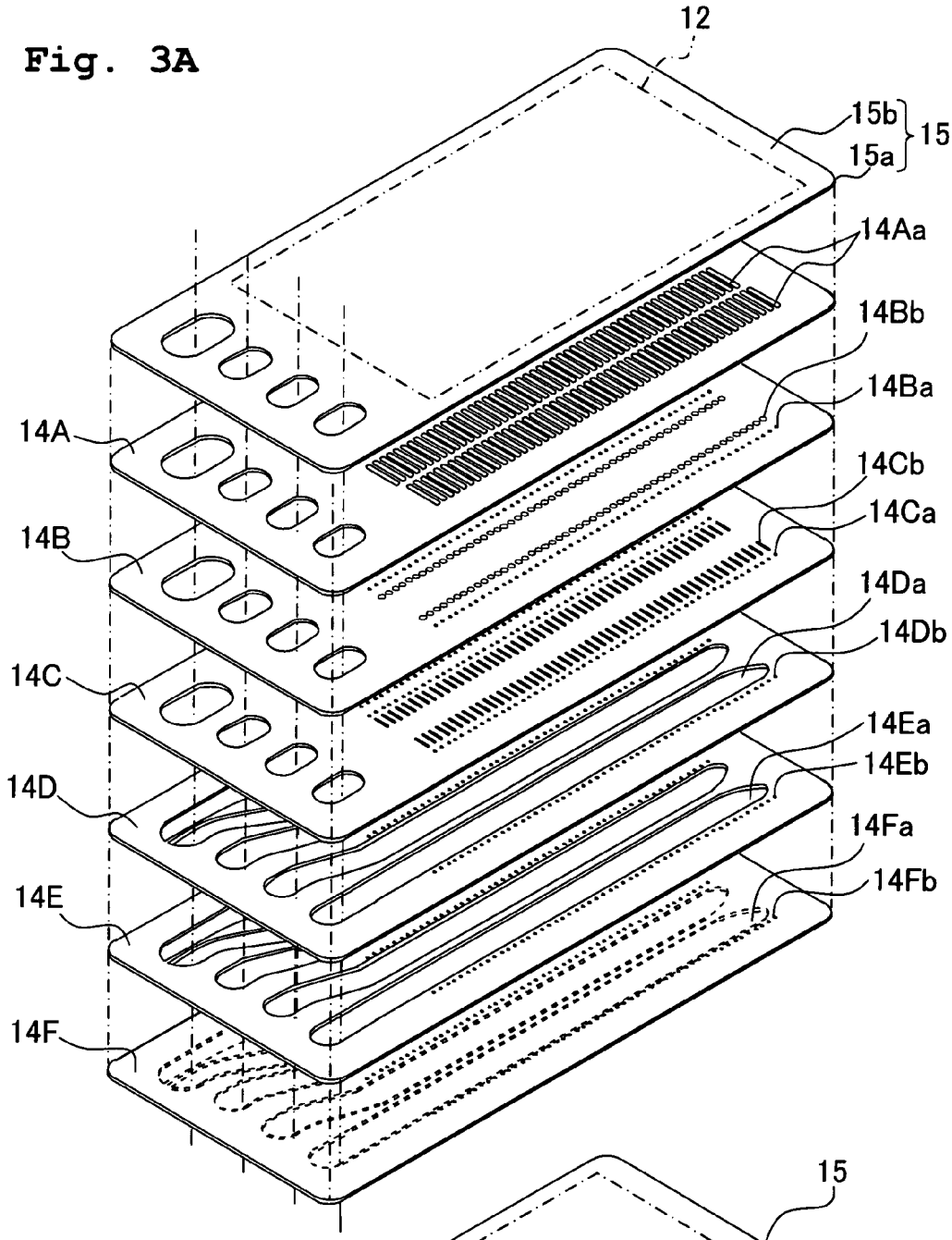
FIG. 3A is a diagram in which the cavity unit is disassembled in various plates which are component, and these plates are shown along with a vibration plate.
Figure 3B:
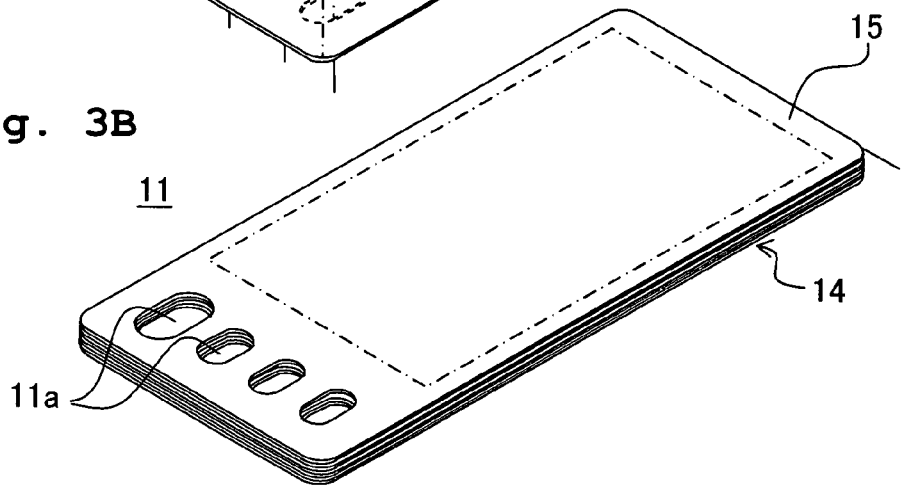
FIG. 3B is a diagram in which the plates are joined.

The stacked body 14, as shown in FIG. 3A and FIG. 3B is a body in which the cavity plate 14A, a base plate 14B, an aperture plate 14C, two manifold plates 14D and 14E, and a damper plate 14F are stacked in this order from an upper side. These six plates 14A to 14F are stacked by aligning mutually such that each of the openings formed in these plates form an ink channel individually for each of the nozzles 16*a*, and are fixed by metallic diffusion bonding. The vibration plate 15 is stacked further on the stacked body 14, and is fixed by the metallic diffusion bonding.

Ink channels in the channel unit 11 are formed by openings in the plates 14A to 14F, and 16, and 17 which are stacked. The ink which flows through the ink channels is discharged from the nozzles 16*a* in the head for the printer 3.

The cavity plate 14A is a rectangular shaped metallic plate, and a plurality of cavities which form the pressure chambers 14Aa is formed along a longitudinal direction of the plate. These pressure chambers 14Aa (cavities) are formed as through holes in the cavity plate 14A by etching. The vibration plate 15 is stacked on an upper surface of the cavity plate 14A, closing the pressure chambers 14Aa (cavities).

The base plate 14B is a metallic plate in which communicating holes 14Ba from manifolds 14Da and 14Ea (common ink chambers) to each of the pressure chambers 14Aa, and communicating holes 14Bb from each of the pressure chambers 14Aa to each of the nozzles 16*a* are formed respectively. The aperture plate 14C is a metallic plate in which communicating channels 14Ca communicating each of the pressure chambers 14Aa and the manifolds 14Da and 14Ea are formed as recess channels on an upper surface of the aperture plate 14C, and communicating holes 14Cb from each of the pressure chambers 14Aa to each of the nozzles 16*a* are formed. The manifold plates 14D and 14E are metallic plates, each provided with communicating holes 14Db and 14Eb from each of the pressure chambers 14Aa to each of the nozzles 16*a*, in addition to the manifolds 14Da and 14Ea. The damper plate 14F is a metallic plate in which, recesses which form damper chambers 14Fa on a lower surface, and communicating holes 14Fb communicating each of the pressure chambers 14Aa and each of the nozzles 16*a*, are formed.

Next, the actuator unit 12 will be described below by referring to FIG. 4A, FIG. 4B, FIG. 4C, and FIG. 5. FIG. 4A is a plan view as viewed from a top surface of the actuator unit 12. FIG. 4B is a plan view as viewed from a bottom surface of the actuator unit 12. FIG. 4C is a cross-sectional view of main components of the actuator unit 12, the vibration plate 15, and the stacked body 14. The actuator unit 12, as shown in FIG. 4C, includes the piezoelectric layer 12A which is formed on the vibration plate 15 (insulating layer 15*b*), a plurality of individual electrodes 12B, 12C, 12D, and 12E which are formed on both surfaces of the piezoelectric layer 12A. On an upper surface (one surface) of the piezoelectric layer 12A, in other words, on a surface of the piezoelectric layer 12A not facing the vibration plate 15, individual electrodes 12B and first common electrodes 12C are formed. On a lower surface (the other surface) of the piezoelectric layer 12A, in other words, on a surface of the piezoelectric layer 12A facing the vibration plate 15, second common electrodes 12D and third common electrodes 12E are formed.

Each of the individual electrodes 12B, as shown in FIG. 4A, is formed on the upper surface of the piezoelectric layer 12A, corresponding to a central portion of each of the pressure chambers 14Aa. In other words, when the actuator unit 12 is viewed from the top, each of the individual electrodes 12B is formed to cover the central portion of each of the pressure chambers 14Aa. The first common electrodes 12C, as shown in FIG. 4A, are formed on the upper surface of the piezoelectric layer 12A, corresponding to both sides in a longitudinal direction of an inner peripheral portion of each of the pressure chambers 14Aa. In other words, when the actuator unit 12 is viewed form the top, the first common electrodes 12C are formed to cover partially the both sides in the longitudinal direction of the inner peripheral portion of each of the pressure chambers 14Aa.

On the other hand, as shown in FIG. 4B and FIG. 4C, the second common electrodes 12D are formed on a lower surface of the piezoelectric layer 12A so that each of the second common electrodes covers partially two adjacent pressure chambers 14Aa. Moreover, each of the third common electrodes 12E is formed to cover the central portion of each of the pressure chambers 14Aa. In other words, each of the third common electrode 12E, is formed on the lower surface of the piezoelectric layer 12A as shown in FIG. 4C, corresponding to each of the individual electrodes 12B on the upper surface of the piezoelectric layer 12A.

Figure 5:
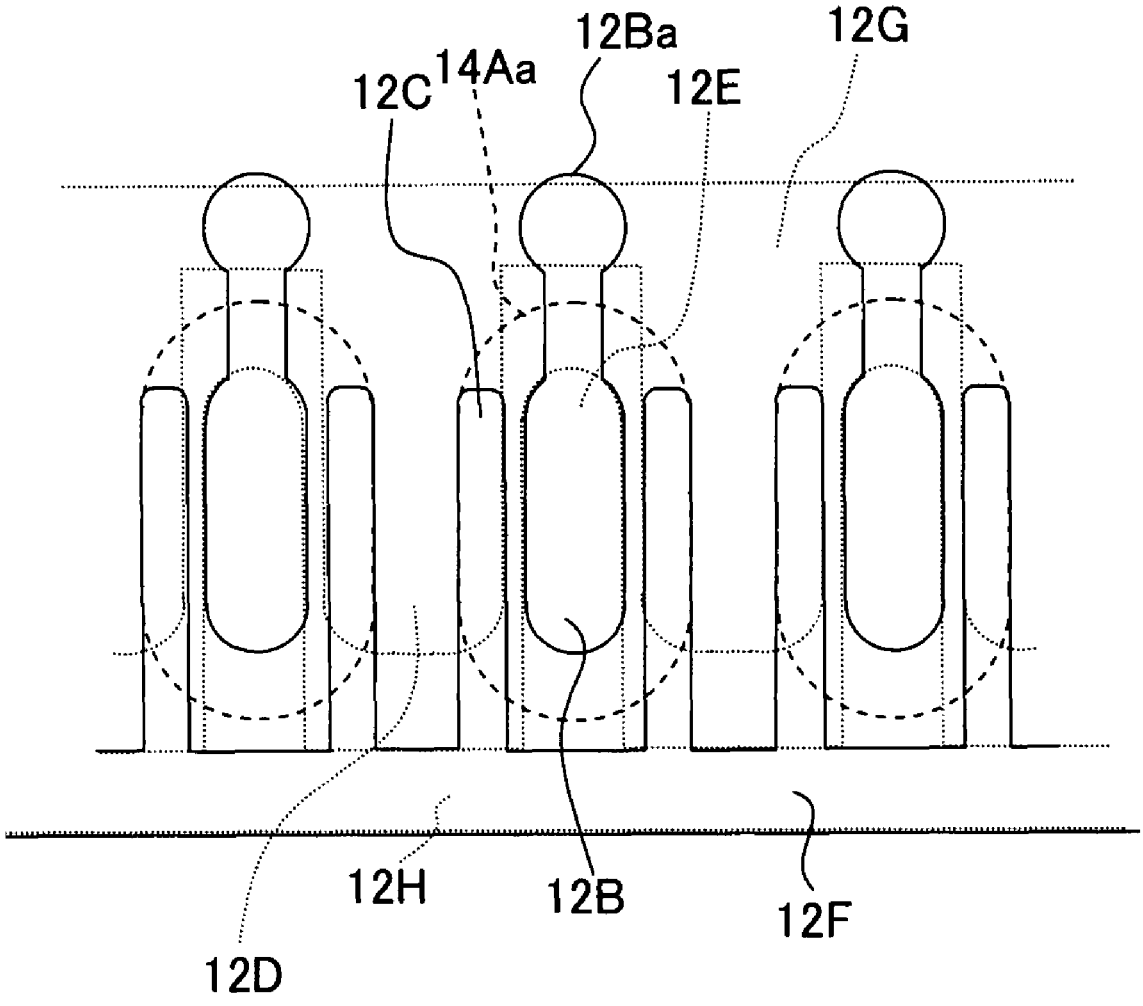
FIG. 5 is a plan view as viewed from a top surface of the actuator unit, showing a positional relationship of the individual electrode, the first common electrode, the second common electrode, and the third common electrode, and connections of the first common electrode, the second common electrode, the third common electrode, with drawn wires.

As shown in FIG. 5, one individual electrode 12B and one third common electrode 12E are formed corresponding to each of the pressure chambers 14Aa. Two first common electrodes 12C are formed corresponding to each of the pressure chambers 14Aa, sandwiching one of the individual electrodes 12B. Moreover, each of the second common electrodes 12D is formed to cover partially the two adjacent pressure chambers 14Aa. Similarly as the second common electrodes 12D, each of the first common electrodes 12C also may be formed to cover partially the two adjacent pressure chambers 14Aa.

Figure 10:
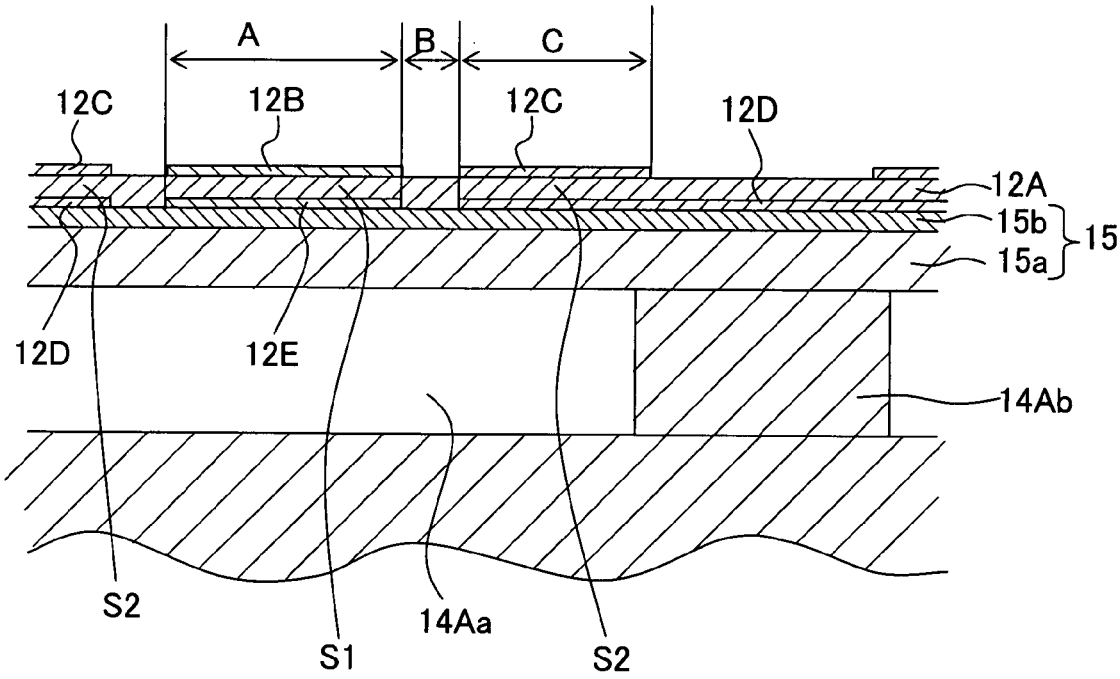
FIG. 10 is a diagram describing dimensions of an individual electrode and the common electrodes, and a spacing distance between the individual electrode and the common electrodes, used for analysis.

To find a relationship of a width of each of the electrodes and a gap (spacing distance) between the electrodes, with an amount of deformation of the vibration plate 15, as shown in FIG. 10, an analysis was carried out by changing the width A of the individual electrodes 12B, a gap B between one of the individual electrodes 12B and one of the adjacent first common electrodes 12C, and width C of the first common electrodes 12C. For simplifying the calculation, each of the first common electrodes 12C was formed such that the first common electrode 12C is not spread over the two adjacent pressure chambers 14Aa (in other words, only each of the second common electrodes was formed to cover partially the two adjacent pressure chambers 14Aa), and when A=40 μm~50 μm, B=25 μm, and C=50 μm~70 μm, it could be confirmed that the amount of deformation of the vibration plate 15 of the jetting channel is substantial, and there is almost no deformation of the vibration plate 15 of the non-jetting channel.

Next, connections of the first common electrodes 12C, the second common electrodes 12D, and the third common electrodes 12E with drawn wires will be described by referring to FIG. 5. FIG. 5 is a plan view showing a positional relationship and connections of the first common electrodes 12C, the second common electrodes 12D, and the third common electrodes 12E, and the drawn wires. The first common electrodes 12C are connected in a comb-teeth form to a first drawn wire 12F extending in a direction of row of the pressure chambers 14A, at an outer side of the pressure chambers 14Aa, in other words, without covering the pressure chambers 14Aa. The second common electrodes 12D and the third common electrodes 12E are connected in the comb-teeth form to a second drawn wire 12G and a third drawn wire 12H extending toward both sides in the direction of row of the pressure chambers 14Aa, without covering the pressure chambers 14Aa. The second drawn wire 12G is provided on the same side as a side on which the individual electrode 12B is drawn, and the first drawn wire 12F and the third drawn wire 12H are provided on a side opposite to the side on which the individual electrode 12B is drawn.

Incidentally, as it has been described above, by arranging the individual electrodes 12B, and the first common electrodes 12C, the second common electrodes 12D, and the third common electrodes 12E, when a performance (capacitance value) of each of the channels is measured in order to select a piezoelectric material (PZT), it is possible to measure the capacitance value at only locations effective for drive.

In other words, firstly, a total capacitance value which is a total amount of the capacitance value of both end portions of each of the pressure chambers 14Aa is measured between the first common electrode 12C and the second common electrode 12D. Since a relative portion of the first common electrode 12C and the second common electrode 12D is only an area effective for piezoelectric deformation, it is possible to measure the capacitance value accurately. According to the measured capacitance value, piezoelectric materials (PZT) are separated to ranks, and a voltage value to be applied is determined.

Next, a capacitance value of an individual drive area is measured between each of the individual electrodes 12B and each of the third common electrodes 12E. Since a relative portion of the individual electrode 12B and the third common electrode 12E is only an area effective for deformation of the piezoelectric material (PZT), it is possible to measure an accurate capacitance value of each of the channels.

By selecting a piezoelectric material (PZT) in such manner, each of the channels has a uniform channel performance (capacitance value) and a stable and uniform discharge performance.

The piezoelectric layer 12A is made of a ferroelectric lead zirconate titanate (PZT) based ceramics material, and is polarized downward in a direction of thickness. The individual electrodes 12B (including a terminal 12Ba of the individual electrodes 12B) and the first common electrodes 12C, the second common electrodes 12D, and the third common electrodes 12E are made of a metallic material such as Ag—Pd material, and are connected to a driving circuit 49 which will be described later, by a signal wire of the flexible cable 13 by which a drive signal is supplied, and the drive voltage is selectively supplied from the driving circuit 49 to the individual electrodes 12B and the first common electrodes 12C, the second common electrodes 12D, and the third common electrodes 12E.

Next, an electrical structure of the ink-jet printer 1 will be described by referring to FIG. 6 and FIG. 7.

Figure 6:
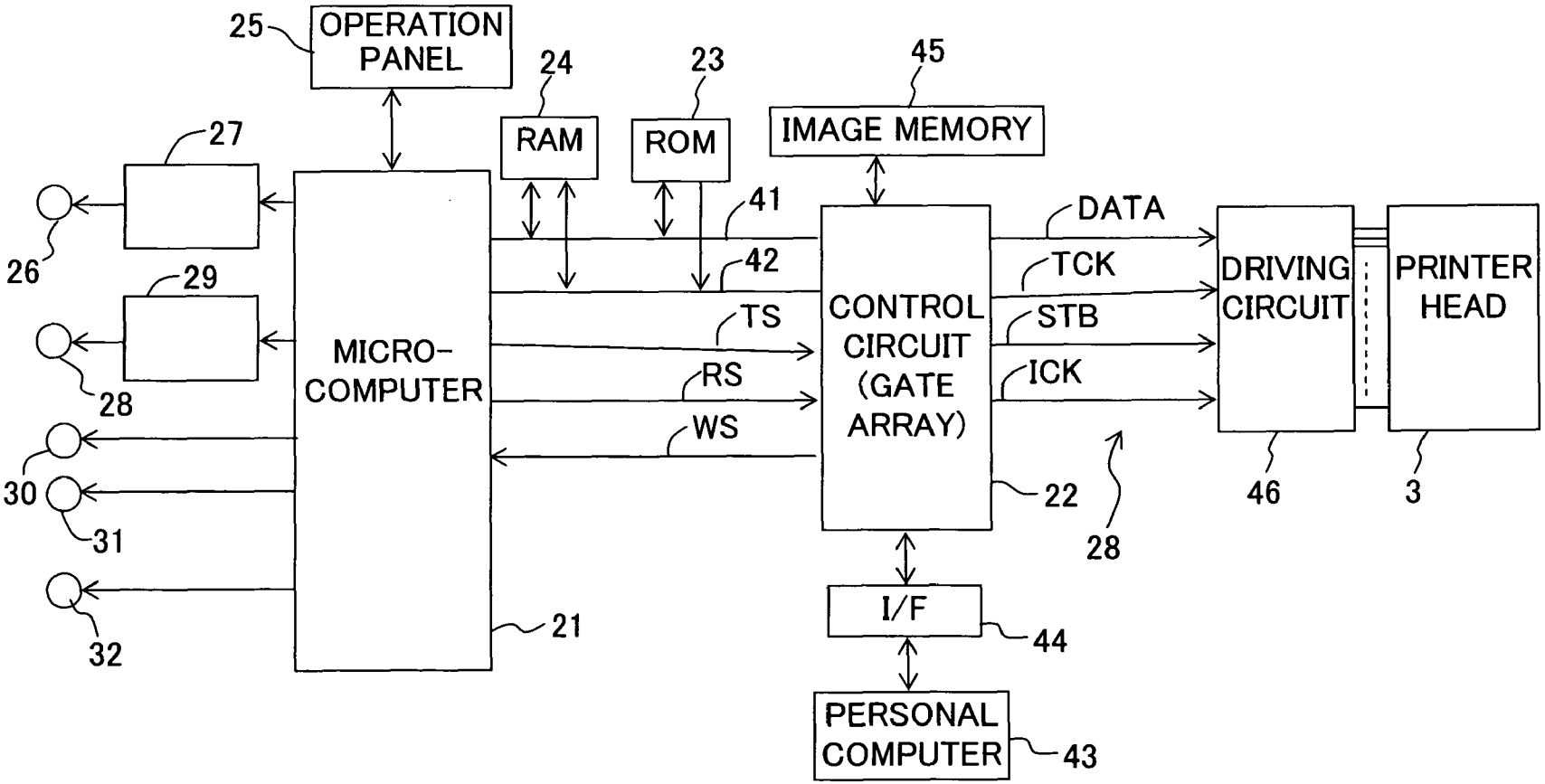
FIG. 6 is a block diagram showing an electric control system of the ink-jet printer.

As shown in FIG. 6, the ink-jet printer 1 includes a CPU (central processing unit) (one-chip micro computer) 21 which controls each portion of the entire ink-jet printer 1, a control circuit (controller) 22 which is a gate (GATE) circuit LSI, a ROM (read only memory) 23 in which control programs and a drive waveform data which jets inks are stored, and a RAM (random access memory) 24 which stores data temporarily.

The CPU 21, is connected to an operation panel 25 for inputting various commands, a motor driver 27 which drives a carriage motor 26 which reciprocates the carriage 2, and a motor driver 29 which drives a transporting motor 28 which drives a transporting unit. Furthermore, the CPU 21 is connected to a paper sensor 30 which detects a presence or an absence of the recording paper P, an origin sensor 31 which detects that the head for the printer 3 at an origin position, and an ink cartridge sensor 32 which detects that an ink cartridge (not shown in the diagram) is in a normal mounted state.

The CPU 21, the ROM 23, the RAM 24, and the control circuit 22 are connected via an address bus 41 and a data bus 42. Moreover, the CPU 21 generates a recording timing signal TS and a control signal RS according to a computer program stored in advance in the ROM 23, and transfers each of the signals TS and RS to the control circuit 22. Moreover, the control circuit 22 stores in an image memory 45 a recording data which is transferred from an external equipment such as a personal computer 43 via an interface 44. Further, the control circuit 22 generates a reception interrupt signal WS from the data which is transferred from the personal computer 43 etc. via the interface 44, and transfers the signal WS to the CPU 21. The control circuit 22, according to the recording timing signal TS and the control signal RS, generates a recording data signal DATA for forming the recording data on the recording paper P, a drive waveform signal ICK, a strobe signal STB, and a transfer clock TCK synchronized with the recording data signal DATA, based on the recording data which is stored in the image memory 45, and transfers each of these signals DATA, TCK, STB, and ICK to the driving circuit 46.

Figure 7:
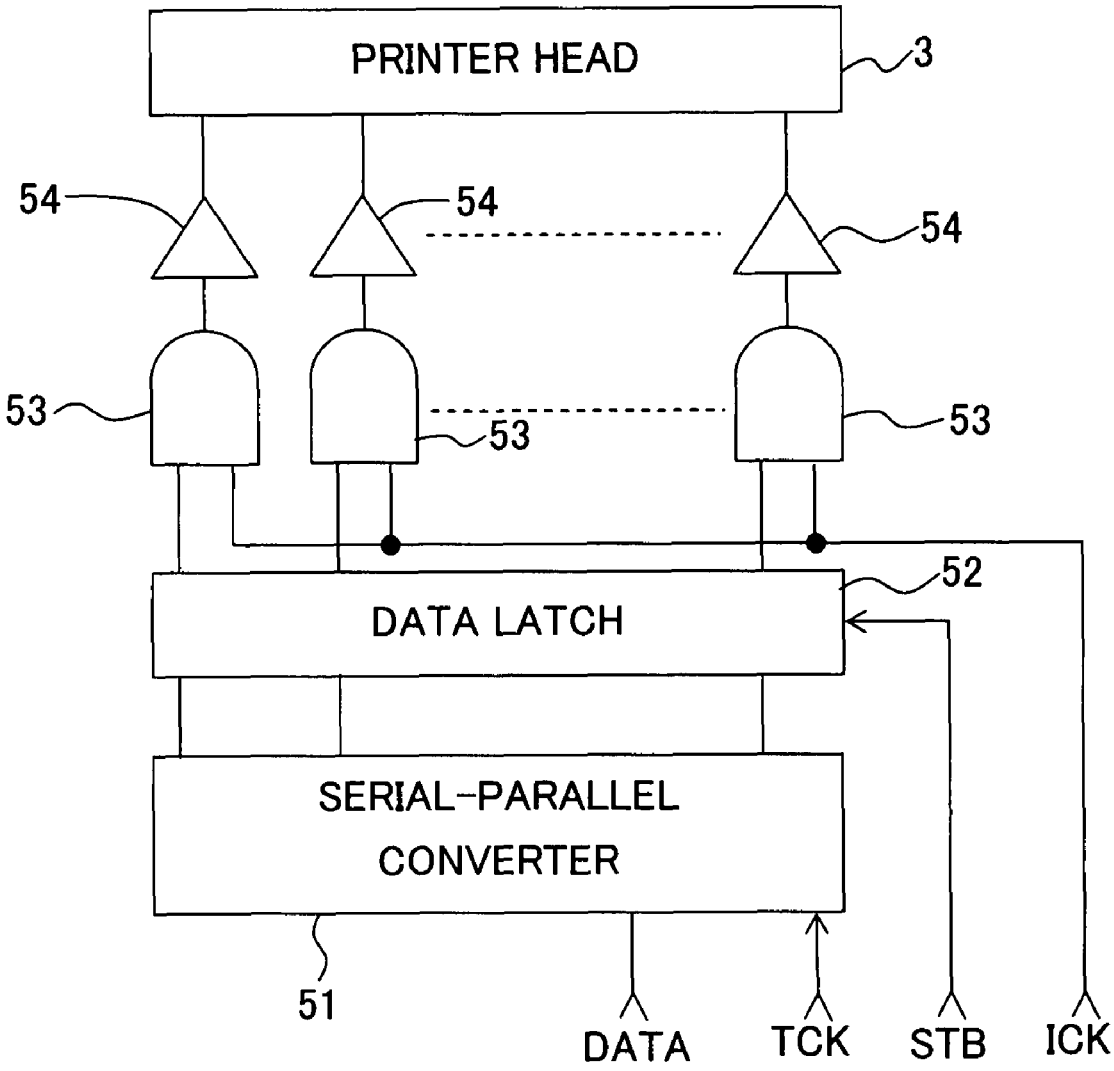
FIG. 7 is a diagram describing an internal structure of a driving circuit.

FIG. 7 is a diagram showing an internal structure of the driving circuit 46. The driving circuit 46 includes a serial-parallel converter 51, a data latch 52, an AND gate 53, and a driver 54. The serial-parallel converter 51 converts the recording data signal DATA which is serial-transferred upon synchronizing with the transfer clock signal TCK from a data transferring section (not shown in the diagram) in the control circuit 22, to parallel data. The data latch 52 latches the parallel data DATA which is converted, based on the strobe signal STB. The AND gate 53 selectively outputs the drive waveform signal ICK based on the parallel data DATA. The driver 54 converts the drive waveform signal which is output to predetermined voltage, and outputs as a drive pulse. The drive pulse which is output from the driver 54 is applied to the individual electrodes 12B and the first common electrodes 12C, the second common electrodes 12D, and the third common electrodes 12E, and displaces the piezoelectric layer 12A. The number of the serial-parallel converters 51, the data latches 52, the AND gates 53, and the drivers 54 matching with the number of nozzles in each head for the printer 3 are prepared. The drive waveform signals ICK are stored in the respective ROM 23, and are read selectively based on the program control.

Figure 8:
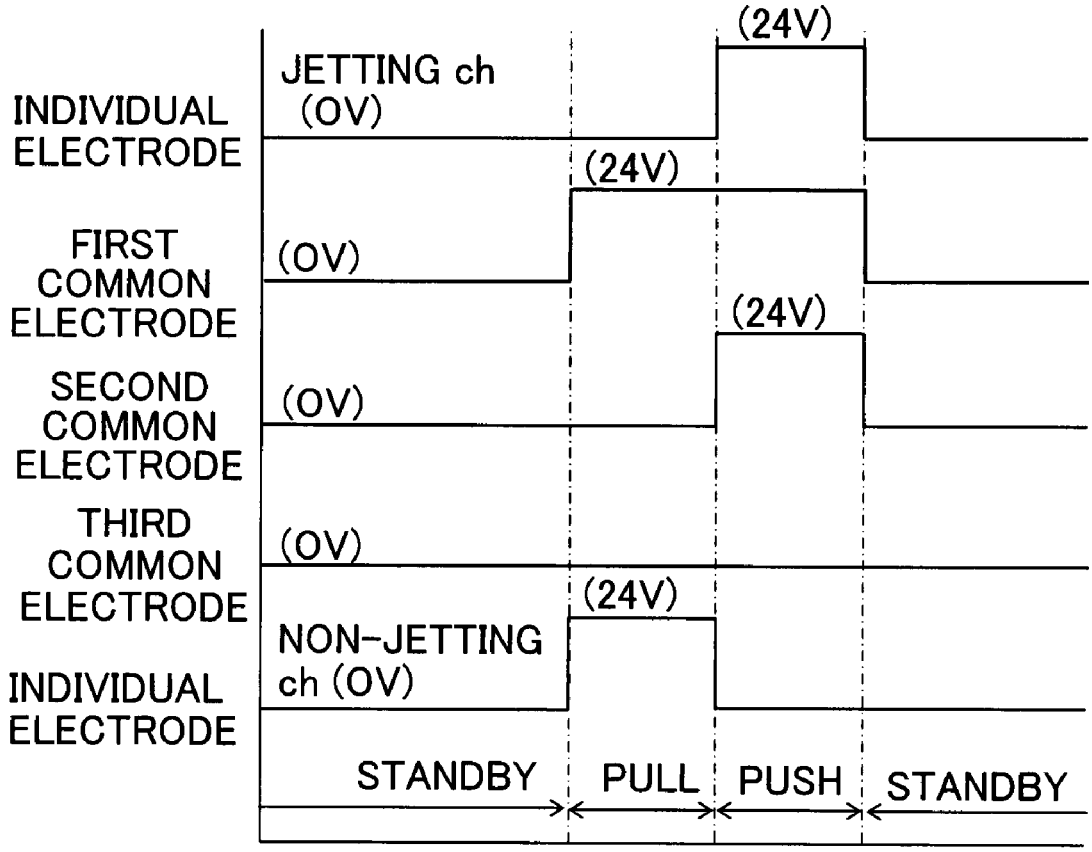
FIG. 8 is a timing chart which shows a temporal change in an electric potential at each electrode.
Figure 9A:
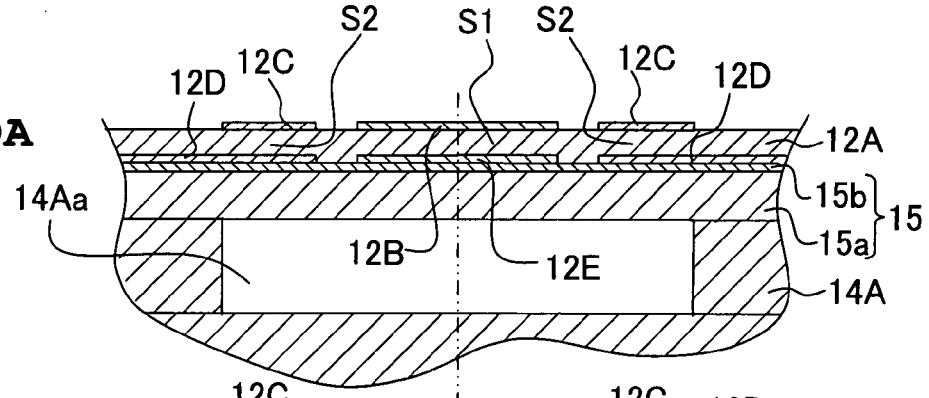
FIG. 9A to FIG. 9E are cross-sectional views of main components of the head showing deformation states of a vibration plate.

Next, a drive operation of the head for the printer 3 described above will be described. In the following description, as shown in FIG. 9A, a portion of the piezoelectric layer 12A, corresponding to the central portion of each of the pressure chambers 14Aa, is called as a first area S1, and each of portions, of the piezoelectric layer 12A, corresponding to both sides in the longitudinal direction of an inner peripheral portion of each of the pressure chambers 14Aa is called as a second area S2. In other words, each of areas sandwiched between the individual electrodes 12B and the third common electrodes 12E is called as the first area S1, and each of areas sandwiched between the first common electrodes 12C and the second common electrodes 12D is called as the second area S2. A first electric potential (for example a ground electric potential) which is a predetermined reference electric potential and a second electric potential (for example 24 V) which differs from the first electric potential are applied selectively as drive pulses from the driving circuit 46 to the individual electrodes 12B, the first common electrodes 12C, the second common electrodes 12D, and the third common electrodes 12E respectively. An example of the electric potentials applied is shown in table 1 and FIG. 8.

TABLE 1

| | | Discharge channel | Non-discharge channel |
|---|---|---|---|
| Standby time | Individual electrodes | 0 V | 0 V |
| | First common electrodes | 0 V | 0 V |
| | Second common electrodes | 0 V | 0 V |
| | Third common electrodes | 0 V | 0 V |
| Pull | Individual electrodes | 0 V | 24 V |
| | First common electrodes | 24 V | 24 V |
| | Second common electrodes | 0 V | 0 V |
| | Third common electrodes | 0 V | 0 V |
| Push | Individual electrodes | 24 V | 0 V |
| | First common electrodes | 24 V | 24 V |
| | Second common electrodes | 24 V | 24 V |
| | Third common electrodes | 0 V | 0 V |

Here, in a case of a pushing ejection, all channels are set to be in ON state (projected downward) immediately before printing, and only channels to discharge an ink are set to be in OFF state, and a negative pressure is generated, and simultaneously with a bouncing (a rebound) of a pressure wave, the channel is put in ON state and the ink is discharged by doubling the pressure wave. Therefore during a standby time, it is a state in which the voltage is applied, and there is a problem of migration. On the other hand, as shown in table 1 in the embodiment, the voltage is not applied to any of the electrodes 12B to 12E during the standby time. Therefore, there is an advantage that the problem of migration does not arise.

Next, a first driving step in which the vibration plate 15 of the jetting channel is deformed to form a projection upward will be described below. For a pressure chamber 14Aa which discharges the ink, the second electric potential is applied to the first common electrodes 12C, and the first electric potential is applied to the second common electrodes 12D and the third common electrode 12E, and the first electric potential is applied to the individual electrode 12B. In other words, while letting the first common electrodes 12C and the second common electrodes 12D to be at different electric potentials, the individual electrode 12B and the third common electrode 12E are kept at the same electric potential.

Figure 9B:
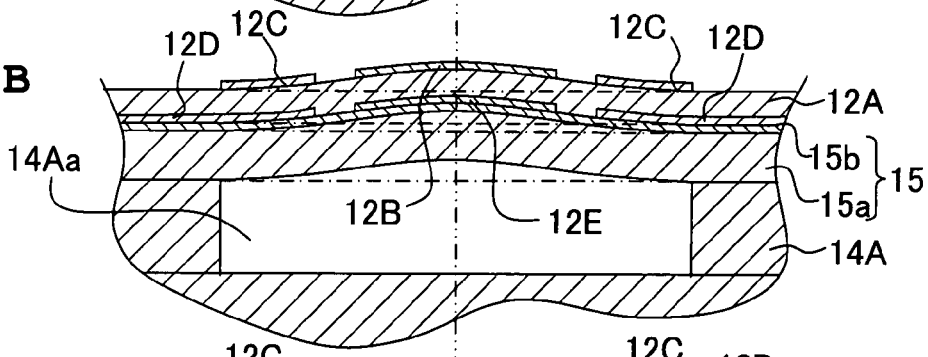

When the drive voltage is applied to the second areas S2, the second areas S2 are contracted in a direction of surface of the piezoelectric layer 12A by a piezoelectric effect. However, since the lower surface of the piezoelectric layer 12A, in other words, the surface facing the pressure chamber 14Aa, is fixed to the vibration plate 15, the upper surface of the piezoelectric layer 12A, in other words, the surface not facing the pressure chamber 14Aa is contracted substantially. Therefore, the second areas S2 are deformed to form a projection in a direction opposite to the pressure chamber 14Aa. In other words, the state is changed from a state shown in FIG. 9A to a state shown in FIG. 9B. In the following description, 'to apply the drive voltage' to the first area S1 or the second areas S2 means to generate an electric potential difference between the first area S1 and the second areas S2.

On the other hand, for the pressure chamber 14Aa which does not discharge the ink, the second electric potential is applied to the first common electrodes 12C, the first electric potential is applied to the second common electrodes 12D and the third common electrode 12E, and the second electric potential is applied to the individual electrode 12B. In other words, while letting the first common electrodes 12C and the second common electrodes 12D to be at different electric potentials, the individual electrode 12B and the third common electrode 12E are let to be at different electric potentials.

Figure 9C:
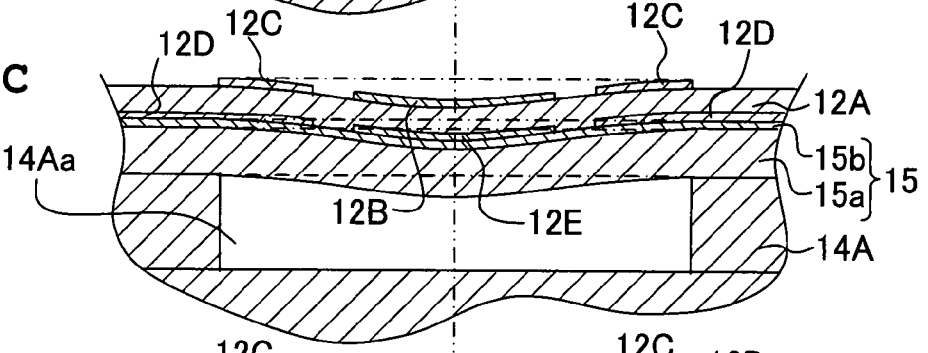
Figure 9D:
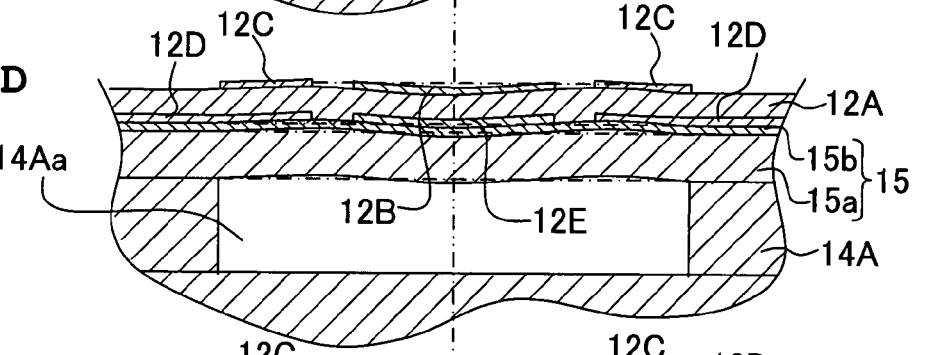

In this case, the second areas S2, due to the drive voltage being applied, are deformed to form a projection in a direction opposite to the pressure chamber 14Aa. On the other hand, since the drive voltage is applied also to the first area S1, the first area S1 is contracted in the direction of surface of the piezoelectric layer 12A due to the piezoelectric effect. However, since the lower surface of the piezoelectric layer 12A, in other words, the surface facing the pressure chamber 14Aa is fixed to the vibration plate 15, the upper surface of the piezoelectric layer 12A, in other words, the surface not facing the pressure chamber 14Aa is contracted substantially. Therefore, the first area is deformed in the direction of the pressure chamber 14Aa. In other words, the deformation of the first area S1 and the second areas S2 are mutually negated, and as a result, it is not deformed in any of the directions (refer to FIG. 9D).

Next, a second driving step of deforming the vibration plate 15 of the jetting channel to form a projection on a lower side will be described below. After carrying out the first driving step, for the pressure chamber 14Aa which discharges the ink, the second electric potential is applied to the first common electrodes 12C and the second common electrodes 12D, the first electric potential is applied to the third common electrode 12E, and the second electric potential is applied to the individual electrode 12B. In other words, while letting the first common electrodes 12C and the second common electrodes 12D to be at the same electric potential, the individual electrode 12B and the third common electrode 12E are let to be at different electric potentials.

In this case, since the drive voltage is not applied to the second areas S2, the piezoelectric effect is not developed (generated), and the second areas S2 are not deformed. On the other hand, since the drive voltage is applied to the first area S1, the piezoelectric effect is developed (generated) and the first area S1 is deformed in the direction approaching toward the pressure chamber 14Aa (refer to FIG. 9C).

For the pressure chamber 14Aa which does not discharge the ink, the second electric potential is applied to the first common electrodes 12C and the second common electrodes 12D, the first electric potential is applied to the third common electrode 12E, and the first electric potential is applied to the individual electrode 12B. In other words, while letting the first common electrodes 12C and the second common electrodes 12D to be at the same electric potential, the individual electrode 12B and the third common electrode 12E are let to be at the same electric potential.

Figure 9E:
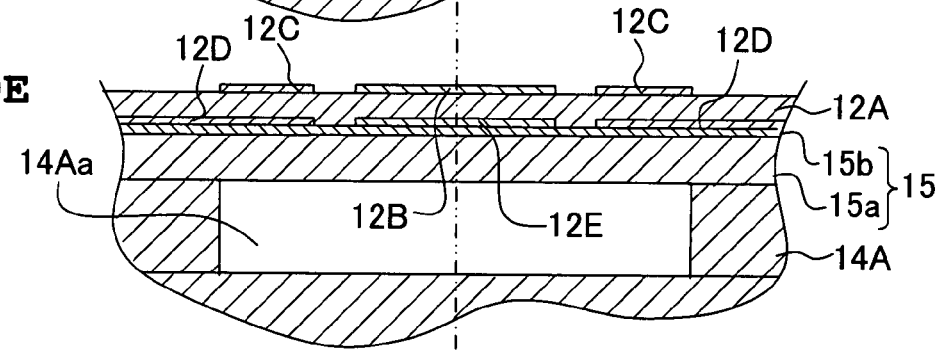

In this case, since the drive voltage is not applied to both the first area S1 and the second areas S2, the piezoelectric effect is not developed, and the first area S1 and the second areas S2 are not deformed in any of the directions (refer to FIG. 9E).

As it has been described above, in the present embodiment, the drive voltage is generated by combining the deformation of the second areas S2 in the first driving step (pulling) and the deformation of the first area S1 in the second driving step (pushing). Consequently, when compared to a head having any one of the pushing ejection and the pulling ejection, it is possible to have a substantial amount of deformation of the piezoelectric layer (actuator) with the same drive voltage, and a high jetting pressure is achieved. Moreover, with a drive voltage lower than in the head having any one of the pushing ejection and the pulling ejection, it is possible to achieve the amount of deformation of the piezoelectric layer of the same degree as in the head having any one of the pushing ejection and the pulling ejection. Moreover, the structure is simple in which the individual electrodes 12B, the first common electrodes 12C, the second common electrodes 12D, and the third common electrodes 12E are arranged sandwiching one piezoelectric layer 12A, and it is not necessary to increase substantially the number of drawn wires 12F to 12H required for wiring these common electrodes 12B to 12E.

Moreover, since in the first driving step, the drive voltage is applied between the first common electrodes 12C and the second common electrodes 12D, in the second driving step, the drive voltage is applied between the individual electrode 12B and the third common electrode 12E, and only an area effective for driving is polarized, the piezoelectric layer 12A becomes stronger against degradation without leaving an unnecessary internal-stress area in the piezoelectric layer 12A.

In the embodiment described above, the individual electrodes 12B and the first common electrodes 12C are arranged on the upper side of the piezoelectric layer 12A, and the second common electrodes 12D and the third common electrodes 12E are arranged on the upper side of the piezoelectric layer 12A. However, it is also possible to make a structure in which the individual electrodes 12B and the first common electrodes 12C are arranged on the lower side of the piezoelectric layer 12A, and the second common electrodes 12D and the third common electrodes 12E are arranged on the upper side of the piezoelectric layer 12A.

The embodiment described above is an example in which the present invention is applied to the head for the ink-jet printer. However, embodiments to which the present invention is applicable are not restricted to this embodiment. According to the present invention, since it is possible to increase the amount of deformation of the actuator without increasing the drive voltage, the present invention without being restricted to an ink droplet jetting apparatus, is also applicable to apparatuses used in various fields such as medical treatment and analysis.

What is claimed is:

1. A head for a liquid-droplet jetting apparatus including a vibration plate which covers a plurality of pressure chambers extending in a predetermined direction, and an insulating layer and a piezoelectric layer which are stacked in this order on a surface of the vibration plate, the surface not facing the pressure chambers, the method comprising:

individual electrodes each of which is formed on one surface of the piezoelectric layer to cover a central portion of one of the pressure chambers;

first common electrodes each of which is formed on the surface of the piezoelectric layer to cover both sides in a longitudinal direction of an inner peripheral portion of one of the pressure chambers;

second common electrodes each of which is formed on the other surface of the piezoelectric layer to cover partially two adjacent pressure chambers among the plurality of pressure chambers; and third common electrodes each of which is formed on the other surface of the piezoelectric layer to cover the central portion of one of the pressure chambers.

2. A liquid-droplet jetting apparatus which jets a liquid droplet of a liquid onto a recording medium, comprising:

a recording medium transporting mechanism which transports the recording medium;

a head for the liquid-droplet jetting apparatus as defined in claim 1; and a controller which controls the head and selectively applies a first electric potential which is a predetermined reference electric potential, and a second electric potential which is different from the first electric potential, to each of the individual electrodes, the first common electrodes, the second common electrodes, and the third common electrodes.

3. The liquid-droplet jetting apparatus according to claim 2, further comprising a driving circuit which drives the head; wherein the controller controls the head via the driving circuit.

4. The liquid-droplet jetting apparatus according to claim 3, wherein when the head is driven, the controller, applies the second electric potential to the first common electrodes, the second common electrodes, and an individual electrode among the individual electrodes corresponding to a pressure chamber among the pressure chambers which jets the liquid droplet, and the first electric potential to the third common electrodes and another individual electrode corresponding to another pressure chamber which does not jet the liquid droplet, after the controller applies via the driving circuit, the second electric potential to the first common electrodes and the another individual electrode corresponding to the another pressure chamber which does not jet a liquid droplet and the first electric potential to each of the second common electrodes, the third common electrodes, and the individual electrode corresponding to the pressure chamber which jets the liquid droplet.

5. The liquid-droplet jetting apparatus according to claim 3, wherein when the head is not driven, the controller applies, via the driving circuit, the first electric potential to each of the individual electrodes, the first common electrodes, the second common electrodes, and the third common electrodes.

6. The head for the liquid-droplet jetting apparatus according to claim 1, wherein the plurality of pressure chambers form a pressure chamber row in a predetermined direction, and the first common electrodes are connected in a comb-teeth form to a first drawn wire which extends, on the one surface of the piezoelectric layer, in a direction of the pressure chamber row, the first drawn wire not covering the pressure chambers; and the second common electrodes and the third common electrodes are connected in a comb-teeth form to a second drawn wire and a third drawn wire respectively, the second and third drawn wires extending, on the other surface of the piezoelectric layer, at both sides in the direction of the pressure chamber row respectively, and not covering the pressure chambers.

7. The head for the liquid-droplet jetting apparatus according to claim 6, wherein the second drawn wire is provided on a side toward which the individual electrodes are drawn, and the first drawn wire and the third drawn wire are provided opposite to the side toward which the individual electrodes are drawn.

8. The head for the liquid-droplet jetting apparatus according to claim 1, wherein each of the first common electrodes is formed to partially cover two adjacent pressure chambers among the plurality of pressure chambers.

9. The head for the liquid-droplet jetting apparatus according to claim 1, wherein a width of each of the individual electrodes and the third common electrodes is about 40 μm to about 50 μm, a width of each of the first common electrodes is about 50 μm to about 70 μm, and a spacing distance between one of the individual electrodes and one of the first common electrodes is about 25 μm.

* * * * *